US008634728B2

(12) United States Patent
Voss et al.

(10) Patent No.: US 8,634,728 B2
(45) Date of Patent: Jan. 21, 2014

(54) METHOD FOR CONTROLLING THE TRANSPORT OF SHEETS THROUGH A PRINTING APPARATUS

(75) Inventors: Eberhard Voss, Buedelsdorf (DE); Stefan Schluenss, Schacht-Audorf (DE); Eckhard Bauer, Kiel (DE)

(73) Assignee: Eastman Kodak Company, Rochester, NY (US)

( * ) Notice: Subject to any disclaimer, the term of this patent is extended or adjusted under 35 U.S.C. 154(b) by 784 days.

(21) Appl. No.: 12/810,152

(22) PCT Filed: Dec. 27, 2007

(86) PCT No.: PCT/EP2007/011428

§ 371 (c)(1),
(2), (4) Date: Jun. 23, 2010

(87) PCT Pub. No.: WO2009/083015

PCT Pub. Date: Jul. 9, 2009

(65) Prior Publication Data

US 2010/0271648 A1 Oct. 28, 2010

(51) Int. Cl.
*G03G 15/00* (2006.01)

(52) U.S. Cl.
USPC ..... 399/20; 399/18; 358/1.12

(58) Field of Classification Search
CPC ..... B41J 11/006
USPC ..... 399/18, 20, 22; 271/262
See application file for complete search history.

(56) References Cited

U.S. PATENT DOCUMENTS

| | | | | |
|---|---|---|---|---|
| 6,411,795 | B2 * | 6/2002 | Okamoto | 399/401 |
| 2003/0107756 | A1 * | 6/2003 | Dan et al. | 358/1.14 |
| 2006/0005114 | A1 | 1/2006 | Williamson et al. | |
| 2006/0222427 | A1 * | 10/2006 | Kang et al. | 399/393 |
| 2007/0018383 | A1 * | 1/2007 | Ohara et al. | 271/262 |

FOREIGN PATENT DOCUMENTS

| | | | |
|---|---|---|---|
| JP | 1048733 | | 2/1989 |
| JP | 2003263076 | A * | 9/2003 |
| WO | 2005/068200 | | 7/2005 |

* cited by examiner

*Primary Examiner* — Matthew G Marini
*Assistant Examiner* — John M Royston
(74) *Attorney, Agent, or Firm* — Peyton C. Watkins

(57) ABSTRACT

The invention relates to a method for controlling the transport of sheets through a printing apparatus, in particular a digital printing apparatus. In the method for controlling the transport of sheets through a printing apparatus, a print queue is set by assigning images to respective sheets, prior to feeding the respective sheets into the transport arrangement. The sheets are then fed into the transport arrangement, and it is detecting whether a double sheet feeding has occurred. Superposed double sheets are deflected to a double sheet box, which is arranged upstream of the at least one print module, and at least those sheets following the superposed double sheet in the transport arrangement, for which an image has already been assigned and which are not in a duplex path, are guided to a waste box, which is arranged downstream of the at least one print module. Finally, the print queue is automatically reset and printing is continued without stopping the printing apparatus.

8 Claims, 3 Drawing Sheets

METHOD FOR CONTROLLING THE TRANSPORT OF SHEETS THROUGH A PRINTING APPARATUS

CROSS-REFERENCE TO RELATED APPLICATION

This application is a national stage entry of International Application PCT/EP07/11428 filed on Dec. 27, 2007.

FIELD OF THE INVENTION

The present invention relates to a printing apparatus and a method for controlling the transport of sheets through a printing apparatus, in particular a digital printing apparatus. In particular, the invention is directed towards handling the occurrence of a double sheet event in a transport arrangement of the printing apparatus.

BACKGROUND OF THE INVENTION

In the field of digital printing it is known to have a printing apparatus having at least one print module and a transport arrangement defining a direction of transport and being arranged for transporting sheets past said at least one printing module for printing thereon. Sheets to be printed are typically fed to the transport arrangement from a paper feed device, which typically feeds sheets one by one into the transport arrangement. During the feeding of the sheets, it may occur that two (or more) sheets are fed into the transport arrangement in a superimposed manner, which occurrence is designated herein as a double sheet event. Such a double sheet event, if undetected, typically leads to a paper jam during the transport of the superimposed sheets through the printing apparatus. If such a paper jam occurs, all the sheets currently in the transport arrangement have to be manually removed and the printing apparatus has to be manually reset to allow a restart thereof. Even though double sheet events only occur sporadically, they may lead to considerable downtime of a printing apparatus during an extended period of time.

In order to avoid a paper jam due to a double sheet event and the need to manually remove the sheets from the transport arrangement, different approaches have been taken in the past.

In one approach, which was used in the NexPress 2001 "Classic", a double sheet waste tray was used between a paper feed device and a print module of the NexPress 2001. Upon detection of a double sheet event, the superimposed sheets were diverted towards the waste tray in order to avoid a paper jam. Subsequently, all sheets in the transport path of the printing apparatus were purged into the proofing tray of the printing apparatus. After the purging, the printing apparatus was automatically stopped and the operator was notified. The operator then had to manually clear the proofing tray and had to manually reset the printing apparatus for a restart thereof. Even though this system may reduce down time of the printing apparatus due to the fact that sheets in the transport path did not have to be removed manually, its still requires substantial input and time of an operator. Furthermore, inasmuch as all sheets in the paper path are purged to the proofing tray in the above system, a large number of waste paper is generated.

SUMMARY OF THE INVENTION

It is therefore an object of the present invention, to overcome one or more of the disadvantages of the prior art.

In accordance with the present invention, a method for controlling the transport of sheets through a printing apparatus as set forth in claim 1 is provided. Further embodiments of the invention are claimed in the dependent claims.

In method for controlling the transport of sheets through a printing apparatus having at least one print module and a transport arrangement defining a direction of transport, which is arranged for transporting sheets past the at least one print module for printing thereon, a print queue is set by assigning images to respective sheets prior to feeding the respective sheets into the transport arrangement. After sheets are fed into the transport arrangement, it is detected whether a double sheet feeding has occurred. Upon detecting a double sheet feeding, the double sheets are deflected to a double sheet box which is arranged upstream of the at least one print module. Furthermore, at least those sheets following the double sheets in the transport arrangement, for which an image has already been assigned and which are not in a duplex path, are guided to a waste box which is arranged downstream of the at least one print module. Finally, the print queue is automatically reset taking into account those sheets deflected towards the double sheet box and the waste box, and printing is continued without stopping the print apparatus. The above method thus provides an automated process for handling double sheet events in an efficient manner without the need for operator intervention.

In accordance with an aspect of the invention, the printing apparatus has at least one print module, at least one sheet supply including a feeder and a transport arrangement defining a transport path having a direction of transport, which transport path is arranged for transporting sheets from said sheet supply past the at least one print module to a sheet output. The printing apparatus also has a double sheet sensor arranged to sense a double sheet event, i.e. occurrence of two superimposed sheets on said transport arrangement, which double sheet sensor is arranged downstream of said paper supply and upstream of said at least one print module in the direction of transport. A double sheet box is arranged downstream of the double sheet sensor and upstream of the at least one print module in the direction of transport. A first deflector is provided, which is operable to selectively deflect sheets on said transport arrangement towards the double sheet box. The printing apparatus has a waste box arranged downstream of said at least one print module and a second deflector operable to selectively deflect sheets on said transport arrangement towards said waste box. Such printing apparatus allows in an efficient manner handling of a double sheet event. By separating a double sheet box from a waste box it is possible to guide sheets correctly fed into the transport arrangement towards the waste box past the at least one print module which may facilitate stabilizing the print process.

The foregoing and other objects, features and advantages of the embodiments will be apparent from the following more detailed description of exemplary embodiments of the method and apparatus, as illustrated in the accompanying drawings.

DETAILED DESCRIPTION OF THE INVENTION

The following description uses relative terms such as left right above and below, which relative terms refer to the drawings and should not be construed to limit the application.

Figure 1:
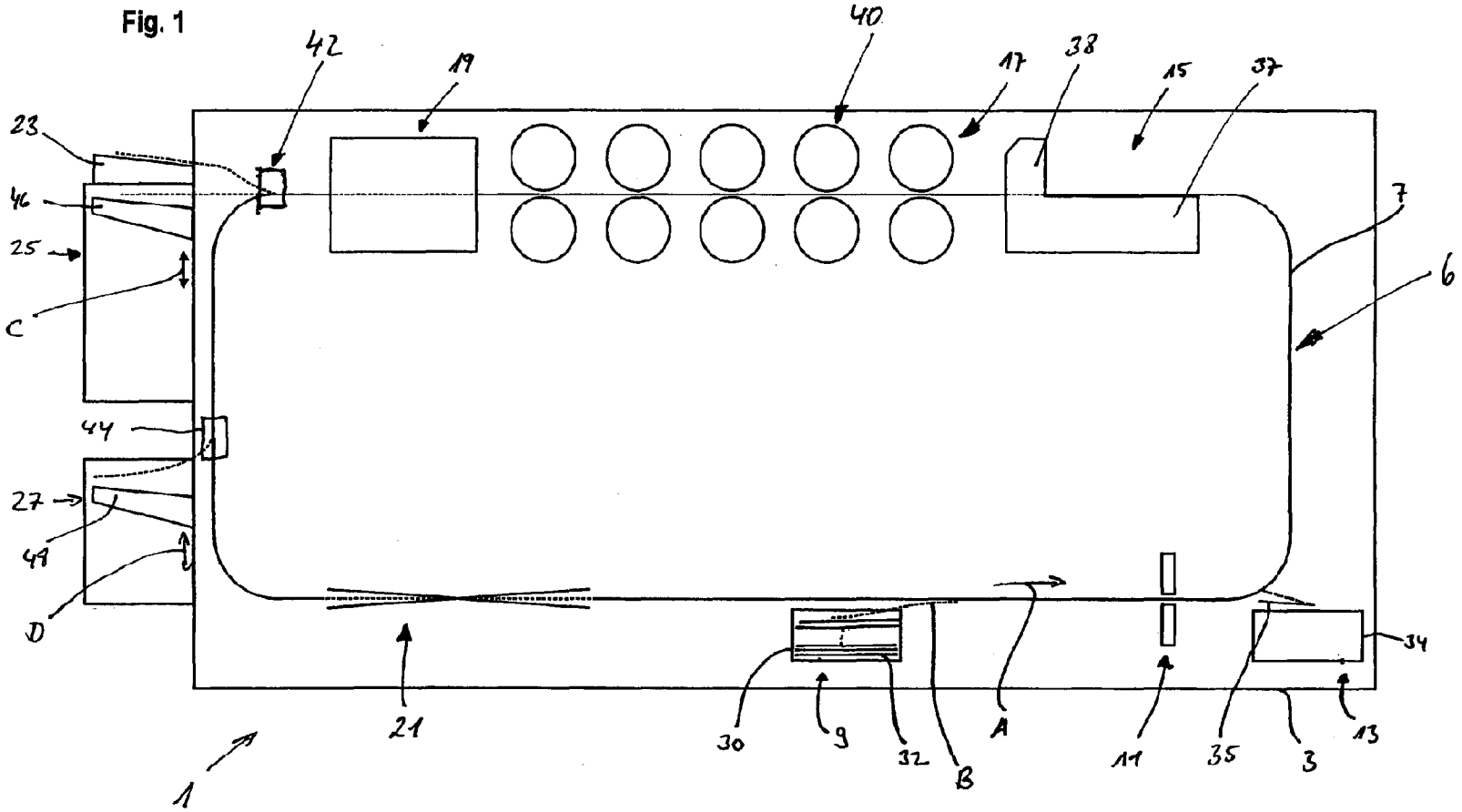
FIG. 1 is a schematic side view of an electro photographic printing apparatus.

FIG. 1 shows a schematic side view of an electro-photographic printing apparatus 1. The printing apparatus 1 has a housing 3 for mounting different elements therein or thereon, as will be described in more detail herein below. Within the housing 3, a transport arrangement 6 defining a transport path 7 is provided. The following are arranged within the housing 3 along the transport path 7: a sheet supply 9, a double sheet sensor arrangement 11, a double sheet box 13, a sheet-aligner 15, a print unit 17, a fuser 19 and an inverter 21.

External to the housing a proofing tray 23, a sheet output 25 and a waste box 27 are provided. Even though these elements are shown outside of the housing 3, they may also be integrated within the housing 3.

The transport arrangement 6 may be of any suitable type for transporting a sheet along the transport path through the printing apparatus 1 and to a sheet receptacle, such as the double sheet box 13, the proofing tray 23, the sheet output 25 or the waste box 27. The transport arrangement 6 as a whole may be formed by a plurality of individual transport devices, which are driven by respective drives and controlled by a controller, for synchronization of a sheet transport throughout the printing apparatus 1. Sheets, which are fed from the sheet supply 9 into the transport path 7 are moved along a direction of transport as indicated by arrow A throughout the printing apparatus 1.

The sheet supply 9 has a storage compartment 30 for storing a stack of sheets 32 and a feeder (not shown) for feeding sheets 32 into the transport path as indicated by the dashed line B. The sheet supply 9 can be of any suitable design for feeding individual sheets 32 into the transport path 7. Even though, FIG. 1 only shows a single sheet supply 9, several sheet supplies, which may for example hold different types of sheets may be provided. These sheet supplies may be arranged in a manner that the sheets are in substance fed into the transport arrangement 6 at the same position.

The double sheet sensor arrangement 11 is arranged downstream along the transport path 7 with respect to the sheet supply 9. The double sheet sensor arrangement 11 may be of any suitable for detecting a double sheet event, i.e. the occurrence of two superposed sheets 32 in the transport path 7. The double sheet sensor arrangement 11 is connected to a controller (not shown) to initiate appropriate action in the event of a double sheet event, as will be described in more detail herein below.

The double sheet box 13 is arranged downstream of the double sheet sensor arrangement 11 along the transport path 7. The double sheet box 13 has a compartment 34 for receiving a plurality of sheets 32, and a deflector 35, for deflecting sheets from said transport path 7 towards the compartment 34. As shown in FIG. 1, the deflector 35 is movable between a non-deflecting position shown by the solid line and a deflecting position shown by a dashed line in FIG. 1. As will be described in more detail herein below, the deflector 35 is typically in the non-deflecting position, and only upon occurrence of a double sheet event it is moved towards the deflecting position in order to guide superposed sheets in the transport path towards the compartment 34. The double sheet box may have means for monitoring the fill level thereof, as a full double sheet box may lead to a paper jam scenario. One way of monitoring is counting the double sheet events and giving out a notice to the operator to clear the double sheet box after a certain amount of double sheet events, to thereby avoid overfilling the double sheet box. Emptying of the double sheet box may also be monitored, for example by a safety switch indicating opening of the double sheet box, which is then taken as an indicator, that it is emptied. Also a sensor directly sensing the fill level of the double sheet box may be provided.

The sheet aligner 15 is arranged downstream of the double sheet box along the transport path 7. The sheet aligner 15 may be of any suitable type for aligning sheets 32 in the transport path for example with respect to skew, with respect to a cross track position, i.e. at right angle to the direction of transport A, and with respect to an in-track position, i.e. in the direction of transport A. The sheet aligner 15 may have a pre-alignment section 37 and a final alignment section 38, as is known in the art.

The print unit 17 is arranged downstream of the sheet aligner 15 and may have one or more electro-photographic print modules 40. The printing apparatus 1 as shown in FIG. 1 has five electro-photographic print modules 40 for the application of toner onto a sheet 32, in a known manner. Depending on the application, a lower or higher number of printing modules 40 may be provided.

Downstream of the printing unit 17 a fuser 19 is provided. The fuser 19 may be of any suitable type for fusing toner applied by the print modules 40 to a sheet 32. The fuser 19 may be of a contact type using for example fusing rollers and/or a fuser belt, or of a non-contact type using for example UV-radiation or microwaves for fusing a toner to a sheet. The type of fuser 19 is at least partially dependent on the toner used in the print module 40.

Downstream of the fuser 19, a guide 42 is provided for selectively guiding a sheet 32 in the transport path 7 towards the proofing tray 23, the sheet output 25 or downwards towards the waste box 27 or inverter 21. The guide 42 may be of any suitable design as will be apparent to a skilled person for guiding a sheet along one of the selected paths.

A further guide 44 is provided downstream of the guide 42 along the transport path 7, for selectively guiding a sheet 32 towards the waste box 27 or further along the transport path 7 to inverter 21 for duplex printing of the sheet. The guide 44 may again be of any suitable type for guiding a sheet in the desired direction.

Inverter 21 is arranged downstream of the guide 44 along the transport path 7 and upstream of the sheet supply 9. The sheet inverter 21 is of any suitable type for inverting a sheet in the transport path, to allow duplex printing of a sheet 32. Inverter 21 is preferably of a type, in which the sheet is inverted in such a manner, that the leading edge of the sheet is not changed during the inversion process.

The section of the transport path 7 extending between sheet supply 9 to the guide 42 may be called a simplex path, while the section extending between guide 42 and sheet supply 9 may be called a duplex path.

The proofing tray 23 may be any suitable tray for receiving sheets 32 thereon for proofing purposes, as known in the art. The sheet output 25 may again be of any suitable design for receiving printed sheets 32. As shown in FIG. 1, the sheet output 25 has a tray 46, which may be moved up and down, as indicated by double-headed arrow C, depending on the number of sheets stacked thereon.

Similarly, the waste box 27 may be of any suitable design for receiving a plurality of sheets, and may have the same general structure as the sheet output 25, including a tray 48 which is movable up and down as indicated by the double-headed arrow D in FIG. 1. Sheet output 25 is typically much larger than waste box 27 as it is expected to receive a much higher number of sheets.

Figure 2:
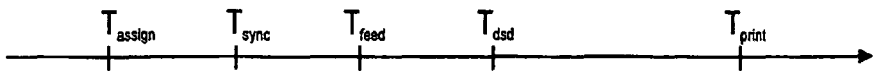
FIG. 2 is a schematic timeline of certain events taking place during the electro photographic printing process.

In the following, normal operation for simplex printing of sheets in the printing apparatus 1 will be described with reference to FIGS. 1 to 3. FIG. 2 shows a schematic time line of different events taking place during the printing process, while FIG. 3 shows a simplified schematic of the printing apparatus used for explaining printing operation.

Figure 3:
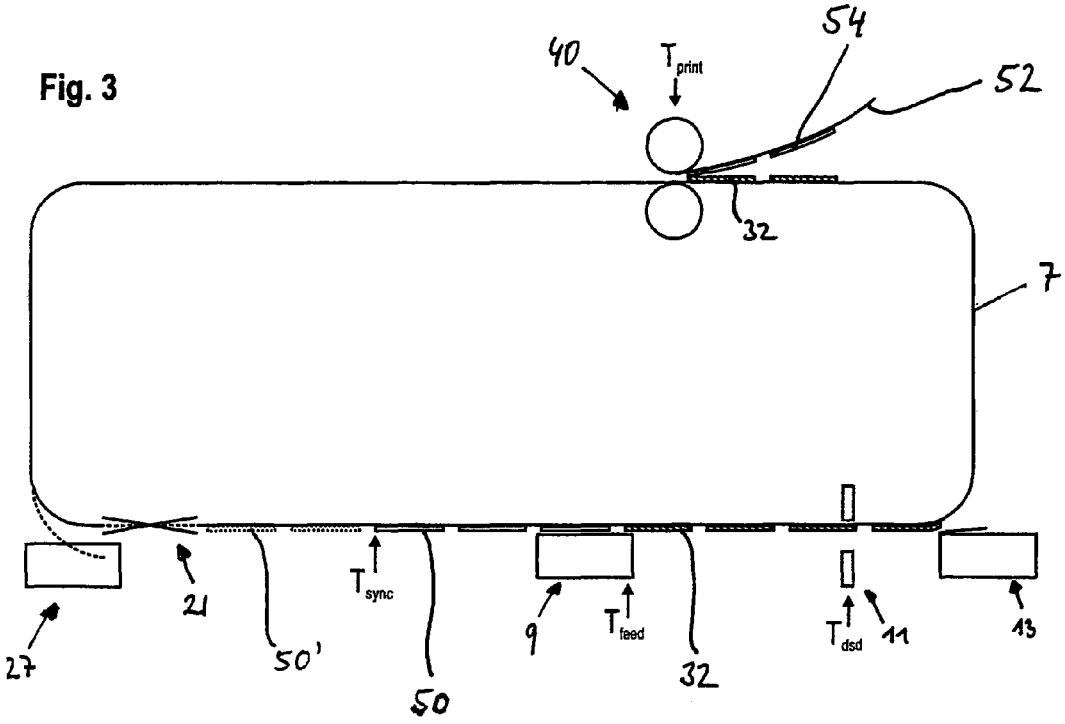
FIG. 3 is a simplified schematic side view of an electro photographic printing apparatus showing a normal operation of the printing apparatus.

In FIG. 3, the same reference signs as used in FIG. 1 will be used for equivalent or similar elements. The simplified view of FIG. 3 shows a transport path 7, a sheet supply 9, a double sheet sensor arrangement 11, a double sheet box 13, a print module 40, a waste box 27 and an inverter 21, which are arranged along the transport path 7 in the above referenced order.

FIG. 3 also shows so-called frames 50, 50', corresponding to desired sheet positions along the transport path, to which virtual images in a print queue are assigned, as will be explained in more detail herein below. The frames 50 represent frames which are synchronized with the virtual images, while frames 50' show unsynchronized frames. As will be obvious to the skilled person, the frames 50, 50' are not stationary but move along the transport path in accordance with the speed of the transport arrangement and FIG. 3 only shows the respective frame positions at an exemplary point in time. Where sheets 32 are present in the position of a frame 50, this is shown by hatching.

At 52 a print queue for the printing process, which corresponds to electrical signals, is represented in a schematic manner. Reference sign 54 represents a virtual image in the print queue, which is to be printed onto a sheet 32 in print module 40.

As indicated in FIG. 2, at a time $T_{assign}$, an image will be assigned to a frame 50' in accordance with a print job. At a time $T_{sync}$, this frame is synchronized with the assigned image, taking into account the speed of the transport arrangement 6, and the print module 40, to achieve a synchronized frame 50. At a time $T_{feed}$, a sheet 32 is fed into the position of a frame 50 (as indicated by showing the frame 50 hatched in FIG. 3). After the sheet has been fed into the frame position, at a time $T_{dsd}$ it is detected, whether more than one sheet is present in a frame position (i.e. a double sheet event has occurred), which is not the case during normal operation. If no double sheet event has occurred, the sheet 32 is then further transported towards the print module 40, where an image is printed onto sheet 32 in accordance with the previous assignment.

Even though not shown in FIG. 3, proper alignment of a sheet 32 with its synchronized frame position 50 may be achieved in an aligner 15 as shown in FIG. 1. Furthermore, FIG. 3 only shows a single print module 40, but the skilled person will realize that further print modules may be provided, each for example printing a single color image onto the sheet 32, in order to generate a multi-color image. After printing an image onto the sheet, the image is fused thereto and the sheet can be guided towards a sheet output, which is not shown in FIG. 3. The above represents normal operation of a simplex printing operation for a sheet 32.

In a duplex printing operation, the sheets, after fusing the image thereto would not be guided to a sheet output, but into a duplex section of the transport path 7, as explained with respect to FIG. 1. The sheet would then be inverted in the inverter 21 and images would then be assigned to the thus inverted sheets in accordance with their corresponding frame positions.

Figure 4:
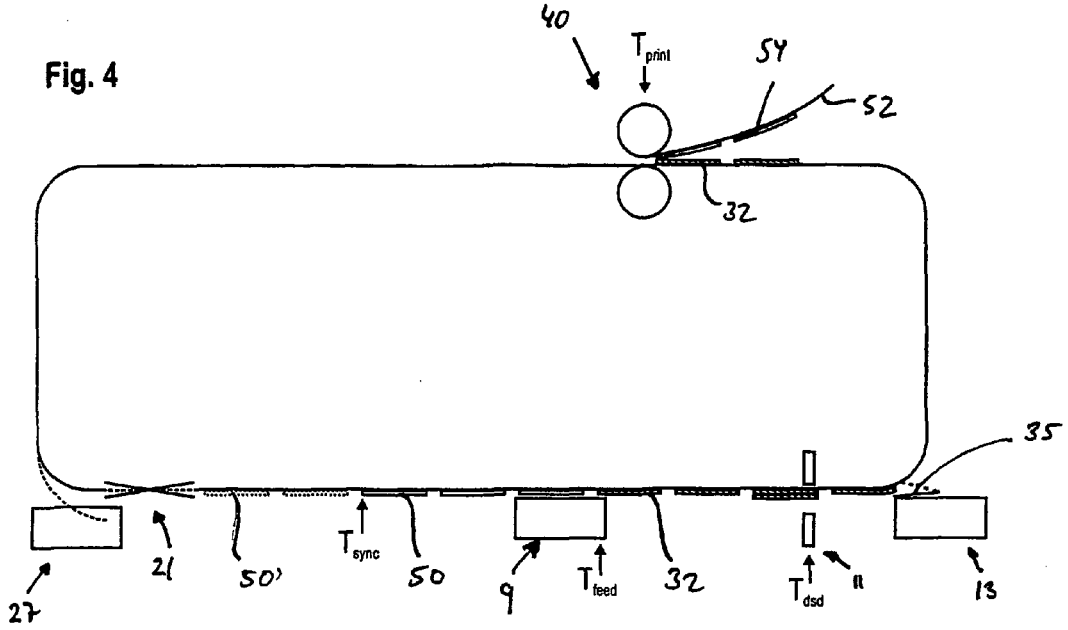
FIG. 4 is a simplified schematic side view of an electro photographic printing apparatus showing a first application of the method for controlling the transport of sheets through the printing apparatus.

FIG. 4 shows a simplified schematic side view of an electro-photographic printing apparatus corresponding to FIG. 3, showing the occurrence of a double sheet event during a simplex printing operation. In accordance with FIG. 4, a first application of a method for controlling the transport of sheets through the printing apparatus upon occurrence of a double sheet event will be described. In FIG. 4 the same reference signs will be used as used in FIG. 3.

Operation is identical to the operation previously described up until the point, that a double sheet event is detected by the double sheet sensor arrangement 11. If such a double sheet event is detected, all the sheets 32, which were fed into the transport path 7 upstream of the superposed sheets 32 are handled in the normal manner, i.e. an image in accordance with the assigned virtual image in the print queue is printed thereon in print module 40. Subsequently these images are fused to the respective sheet and the sheet is then guided to the sheet output.

The virtual image 54 in print queue 52 which was assigned to the frame 50, in which the double sheet event has occurred is deleted, and all of the virtual images 54 in the print queue 52 already assigned to frames 50, 50' downstream of the frame 50, in which the double sheet event has occurred are also deleted from the print queue. The superposed sheets in the frame 50, in which the double sheet event has occurred, are deflected towards the double sheet box 13 by activating the deflector 35 to move into the deflecting position, as shown by the dashed line. Any sheets 32, which have already been fed into a transport path 7 downstream of the frame 50, in which the double sheet event has occurred, are guided through print module 40 into waste box 27. Inasmuch as the virtual images have been deleted from the print queue 52, no images are printed onto these sheets 32. Feeding to those frame positions 50, 50', to which virtual images 54 had previously been assigned in the print queue 52, but which are now deleted is stopped.

The print queue 52 is then automatically reset by re-assigning the virtual image previously assigned to the frame 50, in which the double sheet event had occurred to a new frame 50', which frame 50' is arranged downstream of the frames 50, 50', to which a virtual image had been assigned, but which were deleted from the print queue 52. Subsequently, these frames 50' are synchronized and sheets are fed into the position of the thus synchronized frames 50, in order to resume normal printing operation. It is possible to feed a sheet 32 to a position of a frame (or several frames) which is (are) arranged upstream of the first frame, to which an image has been reassigned. These sheets are guided through the print module without printing thereon and may subsequently be guided to the waste box 27. These sheets may act as so-called leader sheets for stabilizing the printing process, as known in the art.

The method described above, thus allows continuous operation of a printing apparatus despite the occurrence of a double sheet event within the transport path.

Figure 5:
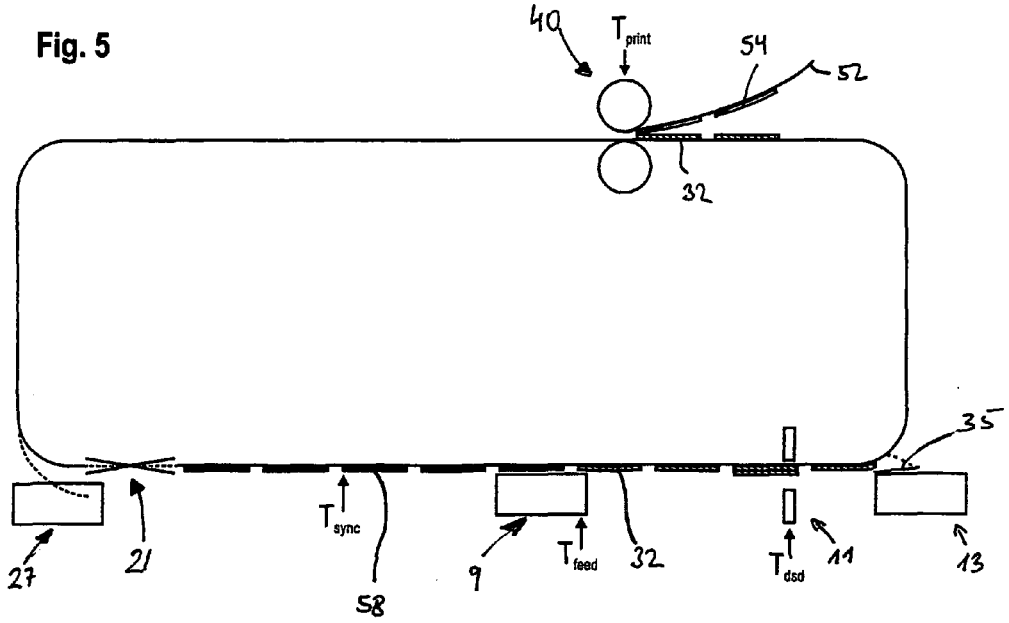
FIG. 5 is a simplified schematic side view of an electro photographic printing apparatus showing an alternative application of the method for controlling the transport of sheets through the printing apparatus.

FIG. 5 shows another simplified schematic side view of an electro-photographic printing apparatus corresponding to FIG. 3, showing the occurrence of a double sheet event during a duplex printing operation. In accordance with FIG. 5, a second exemplary application of a method for controlling the transport of sheets through the printing apparatus upon occurrence of a double sheet event will be described. In FIG. 5 the same reference signs will be used as used in FIG. 3. Inasmuch as FIG. 5 shows a duplex mode of operation, several sheets are shown, which are in the duplex path (i.e. an image has been printed on one side and they are inverted for printing on the reverse side thereof), these sheets are indicated by solid frames 58 in FIG. 5.

Operation is identical to the operation previously described up until the point, that a double sheet event is detected by the double sheet sensor arrangement 11. If such a double sheet event is detected, all the sheets 32, which were fed into the transport path 7 upstream of the superposed sheets 32 are handled in the normal manner, i.e. an image in accordance with the assigned virtual image in the print queue is printed thereon in print module 40. Subsequently these images are fused to the respective sheet and the sheet is then guided into the duplex path.

The virtual image 54 in print queue 52 which was assigned to the frame 50, in which the double sheet event has occurred is deleted. Also those virtual images 54 in the print queue 52, which have been assigned to frames 50 downstream of the frame 50, in which the double sheet event has occurred, and which frames do not belong to sheets in the duplex path are also deleted from the print queue 52. Those virtual images 54 assigned to frames 58, i.e. to frames belonging to sheets in the duplex path, remain in the print queue.

The superposed sheets in the frame 50, in which the double sheet event has occurred, are deflected towards the double sheet box 13 by activating the deflector 35 to move into the deflecting position, as shown by the dashed line. Any sheets 32, which have already been fed into the transport path 7 downstream of the frame 50, in which the double sheet event has occurred, and which are not in a duplex run are guided through print module 40 into waste box 27. Inasmuch as the virtual images have been deleted from the print queue 52, no images are printed onto these sheets 32. Feeding to those frame positions 50, 50', to which virtual images 54 had previously been assigned in the print queue 52, but which are now deleted is stopped. It is, however, possible to feed a sheet 32 to a position of a frame (or several frames) which is (are) arranged upstream of the first frame 58, i.e. a frame belonging to a sheet which is in a duplex run. This (these) sheet(s) is (are) guided through the print module without printing thereon and may subsequently be guided to the waste box 27. This (these) sheets may act as so-called leader sheets for stabilizing the printing process, as known in the art.

Those sheets in frames 58 are guided through the print modules and printing on these sheets is performed in accordance with the virtual images 54 in the print queue 52, as these images were not deleted therefrom. Subsequently these images are fused to the sheets and the sheets are guided towards the sheet output 25.

The print queue 52 is then automatically reset by assigning virtual images 54 first to frames 58, i.e. frames belonging to sheets 32 which are to be printed on the reverse side, including those sheets 32, which were in the position upstream of frame 50, in which the double sheet event has occurred. Then, the virtual image 54, which was previously assigned to the frame 50, in which the double sheet event has occurred is assigned to a frame 50' following the frames 58, and normal printing operation resumed. The method described above, thus allows continuous duplex operation of a printing apparatus despite the occurrence of a double sheet event within the transport path.

The invention has been described above with reference to specific embodiments of the invention, without being limited to these specific embodiments. The scope of the invention is defined by the appended claims.

The invention claimed is:

1. A method for controlling the transport of sheets through a printing apparatus having at least one print module and a transport arrangement defining a direction of transport, arranged for transporting sheets past said at least one print module for printing thereon, said method comprising the steps of:

(a) setting a print queue by assigning images to respective sheets, prior to feeding the respective sheets into the transport arrangement;

(b) feeding sheets into the transport arrangement;

(c) detecting whether a double sheet feeding has occurred;

(d) deflecting superposed double sheets to a double sheet box, which is arranged upstream of the at least one print module;

(e) guiding any non-superposed sheets following the superposed double sheet in the transport arrangement, for which an image has already been assigned and which are not in a duplex path, to a waste box, which is arranged downstream of the at least one print module; and (f) automatically resetting the print queue and continuing to print without stopping the printing apparatus.

2. The method of claim 1, wherein resetting the print queue comprises deleting the previous assignments of images for those sheets which are guided to the double sheet box and the waste box and rescheduling assignment of these images to respective sheets to be fed into the transport arrangement.

3. The method as in claim 1, wherein setting the print queue is done in a batch manner, wherein a batch of two or more sheets to be printed on a first side is followed by a batch of two or more sheets, which are in a duplex path and have a print on the first side and are to be printed on a second side.

4. The method as in claim 1, wherein resetting the print queue comprises deleting the previous assignments of images for those sheets which are in the same batch, in which the double sheet event has occurred, and rescheduling assignment of these images to respective sheets to be fed into the transport arrangement following printing of the sheets in the duplex path.

5. The method as in claim 2, wherein at least one sheet is fed into the transport arrangement prior to a sheet having a rescheduled image assignment, which at least one sheet is guided to said waste box, which is arranged downstream of the at least one print module.

6. The method as in claim 1, wherein feeding sheets into the transport arrangement is stopped after detecting a double sheet event until the print queue is reset.

7. The method as in claim 1, wherein all non-superposed sheets following the double sheet, which have previously been fed into the transport arrangement, are guided to said waste box.

8. The method as in claim 1, wherein a notification is given to an operator, indicating the occurrence of a double sheet event.

* * * * *